United States Patent [19]

Schmidt et al.

[11] 4,236,535

[45] Dec. 2, 1980

[54] APPARATUS FOR CONVOLUTING ADHESIVE-COATED UNITING BANDS AROUND ROD-SHAPED ARTICLES

[75] Inventors: Rolf Schmidt, Glinde; Herbert Berlin, Hamburg, both of Fed. Rep. of Germany

[73] Assignee: Hauni-Werke Korber & Co. KG, Hamburg, Fed. Rep. of Germany

[21] Appl. No.: 959,860

[22] Filed: Nov. 13, 1978

[30] Foreign Application Priority Data

Nov. 23, 1977 [DE] Fed. Rep. of Germany ..... 2752173

[51] Int. Cl.[3] ..... A24C 5/47

[52] U.S. Cl. ..... 131/21 R; 131/94

[58] Field of Search ..... 131/58, 61 R, 67, 68, 131/69, 94, 21, 72; 156/505; 198/377; 93/1 C, 77 FT

[56] References Cited

U.S. PATENT DOCUMENTS

| | | | |
|---|---|---|---|
| 3,067,754 | 12/1962 | Pinkham et al. | 131/94 |
| 3,212,507 | 10/1965 | Schubert | 131/94 |
| 3,483,873 | 12/1969 | Hinzmann | 131/94 |
| 3,527,234 | 9/1970 | Hinzmann | 131/94 |
| 3,583,546 | 6/1971 | Koop | 198/377 |
| 3,730,811 | 5/1973 | Wendt | 156/505 |
| 3,794,048 | 2/1974 | Molins et al. | 131/94 |
| 3,962,957 | 6/1976 | Hinzmann | 131/17 R |

FOREIGN PATENT DOCUMENTS

| | | | |
|---|---|---|---|
| 2018093 | 4/1970 | Fed. Rep. of Germany | 131/68 |
| 2056476 | 5/1972 | Fed. Rep. of Germany | 131/58 |
| 1161197 | 7/1974 | Fed. Rep. of Germany . | |

*Primary Examiner*—Robert W. Michell
*Assistant Examiner*—Thomas Wallen
*Attorney, Agent, or Firm*—Peter K. Kontler

[57] ABSTRACT

A filter cigarette making machine wherein two plain cigarettes of unit length are connected to a coaxial filter plug of double unit length therebetween by an adhesive-coated uniting band which is convoluted around the filter plug and the inner ends of the plain cigarettes. The machine has a rotary drum-shaped draping conveyor and a heated stationary block-shaped rolling device adjacent to the peripheral surface of the conveyor to normally define therewith a gap of a width slightly less than the diameter of a group consisting of two coaxial plain cigarettes and a filter plug therebetween. Successive groups, each of which carries a non-convoluted uniting band, are fed into the gap by moving sideways whereby the groups roll about their own axes and the uniting bands are converted into tubular envelopes. A parallel motion automatically retracts the rolling device from the draping conveyor when the prime mover of the machine is arrested whereby the groups between the conveyor and the rolling device are free to leave the machine by gravity. This insures that filter plugs which are sensitive to heat cannot adhere to or contaminate the peripheral surface of the draping conveyor and/or the adjacent surface of the rolling device. The parallel motion is actuated by a double-acting pneumatic cylinder and piston unit which receives pressurized fluid by way of a valve whose solenoid is controlled by a tachometer generator which monitors the speed of the draping conveyor.

10 Claims, 1 Drawing Figure

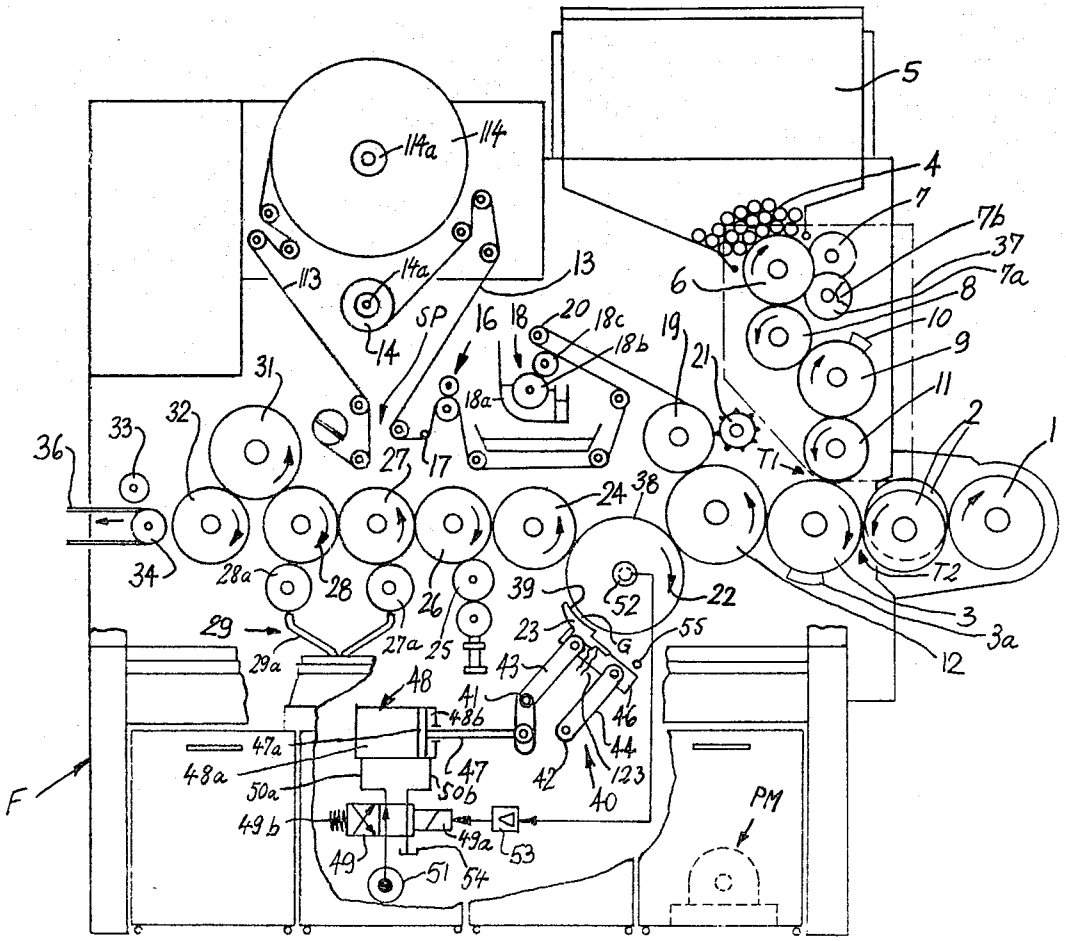
1
2
3
3a
12
T2
T1
4
5
7
7b
37
7a
8
10
9
11
6
19
21
22
55
38
24
52
G
46
44
123
40
42
39
23
43
41
48b
47
50b
49a
53
54
51
49
18b
18c
20
18
18a
16
13
114
114a
14a
14
SP
17
27
26
25
27a
48
28
28a
29a
29
31
32
33
34
36
113
47a
50a
49b
48a
PM
F

APPARATUS FOR CONVOLUTING ADHESIVE-COATED UNITING BANDS AROUND ROD-SHAPED ARTICLES

BACKGROUND OF THE INVENTION

The present invention relates to machines for manipulating rod-shaped articles which constitute or form part of smokers' products. More particularly, the invention relates to machines wherein groups of two or more coaxial rod-shaped articles are connected to each other by adhesive-coated uniting bands which are convoluted around the respective groups while the groups move sideways through a gap whose width is less than the diameters of articles which form a group. Still more particularly, the invention relates to improvements in apparatus which form part of such machines and define the aforementioned gaps wherein groups of coaxial rod-shaped articles roll about their respective axes.

Filter cigarettes are normally produced in machines wherein two plain cigarettes of unit length are connected with a filter plug of double unit length by means of an adhesive-coated uniting band which is draped around the filter plug and the adjacent end portions of the plain cigarettes. The resulting filter cigarette of double unit length is thereupon severed midway between its ends to yield a pair of filter cigarettes of unit length. The draping of uniting bands takes place while the plain cigarettes and the respective filter plugs are caused to move sideways between the peripheral surface of a rotary drum-shaped draping conveyor and a stationary rolling device. As a rule, the rolling device is heated to promote the setting of adhesive which is applied to those sides of the uniting bands that contact the respective filter plugs and the inner end portions of corresponding plain cigarettes. Such heating presents problems when the filter plugs contain or consist of a filter material which is sensitive to heat. For example, the so-called NWA-filters (namely, non-wrapped-acetate filters) are likely to adhere to the rolling device and/or to the draping conveyor during prolonged dwell in the gap between the conveyor and the rolling device. This can happen when the machine is arrested, e.g., due to a malfunction of one of its units.

The uniting bands which are located in the gap between the rolling device and the draping conveyor are in different stages of conversion into tubular envelopes, i.e., at least some of the filter plugs are exposed and, therefore, such filter plugs are even more likely to adhere to the heated surface of the rolling device. This can entail a lengthy interruption of operation in order to remove molten material from the rolling device and/or from the periphery of the draping conveyor. Each interruption is extremely costly because a modern filter cigarette making machine turns out a minimum of seventy articles per second. NWA-filters normally contain a solvent, such as triacetin, which bonds portions of filaments to each other in order to provide a maze of passages for tobacco smoke and to thus insure interception of high percentages of tar and nicotine while the smoke flows toward the smoker's mouth. Triacetin melts in response to heating and flows onto the adjacent surfaces of the rolling device and/or draping conveyor when a filter of such type is compelled to remain in the gap for a relatively long period of time. As mentioned above, NWA-filters are unwrapped, i.e., their peripheral layers are merely reinforced as a result of suitable thermal or chemical treatment whereby such reinforced layers constitute porous envelopes. Therefore, when a porous envelope is permitted to directly contact the heated rolling device while the draping conveyor is idle, the filter undergoes partial disintegration and contaminates the adjacent parts of the machine.

OBJECTS AND SUMMARY OF THE INVENTION

An object of the invention is to provide a novel and improved apparatus which can properly convert adhesive-coated uniting bands into tubular envelopes during normal operation of a filter cigarette making or like machine, and which invariably insures that its parts are not contaminated when the machine comes to a standstill or its speed decreases to a value at which the constituents of groups of rod-shaped articles to which the uniting bands adhere are likely to be damaged as a result of overheating.

Another object of the invention is to provide a machine which can reliably process so-called NWA-filters.

A further object of the invention is to provide a machine wherein NWA-filters or other types of heat-sensitive rod-shaped articles which form part of or constitute smoker's products cannot be overheated and cannot contaminate the machine as a result of stoppage or pronounced slowdown of the machine.

The invention is embodied in an apparatus which forms part of a machine for processing rod-shaped articles, especially rod-shaped articles which constitute or form part of smokers' products. More particularly, the invention is embodied in an apparatus which preferably forms part of a machine for the manufacture of filter tipped smokers' products and wherein such products are obtained by moving groups of coaxial rod-shaped articles sideways and draping adhesive-coated uniting bands around selected portions of such groups.

The apparatus comprises a rotary draping device (e.g., a drum whose cylindrical peripheral surface has equally spaced webs or ribs extending in parallelism with the axis of the drum and flanking convex rolling facets for groups of rod-shaped articles), a rolling device (e.g., a block having a concave group-contacting surface and being normally adjacent to a portion of the peripheral surface of the rotary draping device), means for heating at least one of the devices (such heating means may include one or more electric resistance heaters which are mounted in or on the rolling device or one or more coils which circulate a heated fluid in the interior of the rolling device), displacing means (e.g., a parallel motion mechanism) for moving one of the devices (preferably the rolling device) between a first position in which the one device is nearer to the other device and the two devices define a gap having a width slightly less than the diameter of a group of coaxial rod-shaped articles and a second position in which the one device is more distant from the other device so that any group or groups in the aforementioned gap can leave the gap by gravity as soon as the one device moves to the second position, a rotary drum-shaped conveyor or analogous means for delivering groups of rod-shaped articles and non-convoluted uniting bands to the draping device ahead of the gap (as considered in the direction of rotation of the draping device) in the first position of the one device whereby the groups of articles are caused to rotate about their respective axes and the corresponding uniting bands are convoluted therearound during transport through the gap, and means for actuating the displacing means to move the one device to the second position in automatic response to stoppage or slowdown of the machine. Such stoppage or slowdown can be detected, for example, by monitoring the speed of the rotary draping device. Since the draping device receives torque from the main prime mover of the machine which embodies the improved apparatus, detected reduction of the speed of the draping device to a predetermined minimum value (normally zero speed) is tantamount to detection of stoppage of the prime mover, i.e., stoppage of the entire machine.

The actuating means may comprise a motor (e.g., a fluid-operated motor and preferably a double-acting pneumatic cylinder and piston unit) which automatically moves the one device to second position when the machine is arrested and which automatically returns the one device to the first position when the speed of the machine is normal or acceptable. Since at least one of the devices is heated, and since the groups of rod-shaped articles are permitted to leave the gap as soon as the one device is moved to the second position, heat-sensitive rod-shaped articles which may constitute one or more elements of each group of articles cannot remain in contact with and cannot be overheated and eventually caused to melt on and adhere to the heated device. As explained above, this is especially important if at least one component of each group is a non-coated acetate filter plug which is likely to adhere to the adjacent surface of the heated device in response to prolonged contact with such surface.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic front elevational view of a filter cigarette making machine including an apparatus which embodies one form of the invention, the movable device being shown in that position in which the draping and rolling devices define a gap of satisfactory width for conversion of adhesive-coated uniting bands into tubular envelopes during travel of uniting bands and the respective groups of rod-shaped articles through the gap.

DESCRIPTION OF THE PREFERRED EMBODIMENTS

The drawing shows a filter cigarette making or filter tipping machine of the type known as MAX S (produced by Hauni-Werke Körber & Co. KG., of Hamburg, Federal Republic Germany). This machine is directly coupled with a cigarette maker which includes a rotary drum-shaped row forming conveyor 1. Plain cigarettes of unit length which issue from the maker are propelled into successive peripheral flutes of the conveyor 1 in such a way that the cigarettes form two rows one of which is adjacent to one axial end and the other of which is adjacent to the other axial end of the conveyor 1. The cigarettes of one row are received in the oddly numbered flutes and the cigarettes of the other row are received in the evenly numbered flutes of the conveyor 1. The width of the gap between the two rows of cigarettes on the conveyor 1 preferably slightly exceeds the length of a filter rod section of double unit length.

The frame F of the filter cigarette making machine supports two rotary drum-shaped aligning conveyors 2 which are disposed one behind the other, as viewed in the drawing, and respectively accept successive plain cigarettes of the one and the other row. The conveyors 2 are driven to rotate at different speeds and/or transport the plain cigarettes of the respective rows through different distances so that each plain cigarette of one row is aligned with a plain cigarette of the other row when such cigarettes reach a transfer station T2 where the conveyors 2 deliver plain cigarettes into successive flutes of a rotary drum-shaped assembly conveyor 3. The directions in which the conveyor 1 and the conveyors of the filter cigarette making machine rotate are indicated by arrows.

The frame F supports a magazine 5 for a supply of parallel filter rod sections 4 of eight times unit length. The outlet of the magazine 5 is located above and delivers filter rod sections 4 into successive peripheral flutes of a rotary drum-shaped severing conveyor 6 which transports the sections 4 seriatim first past a rotary disk-shaped knife 7 which divides each section 4 into two shorter sections of four times unit length, and thereupon past two additional disk-shaped rotary knives *7a, 7b* which divide the shorter sections into pairs of filter rod sections of double unit length. Successive sets of four coaxial filter rod sections of double unit length (hereinafter called filter plugs for short) are delivered to four discrete rotary disks of a conventional staggering conveyor 8. The disks of the conveyor 8 rotate at different speeds and/or transport the respective filter plugs through different distances so as to convert each set of four coaxial filter plugs into a row of filter plugs which are staggered with respect to each other, as considered in the circumferential direction of the conveyor 8. Successive filter plugs of such rows are introduced into successive peripheral flutes of a rotary drum-shaped shuffling conveyor 9 which cooperates with one or more cams 10 to shifft some or all of the filter plugs axially so that the rows of staggered filter plugs are converted into a row wherein each preceding filter plug is in exact alinement with the next-following filter plug. Successive filter plugs of the row of aligned filter plugs are transferred into successive flutes of a rapidly rotating drum-shaped accelerating conveyor 11 which inserts successive filter plugs into successive flutes of the assembly conveyor 3 at a transfer station T1 located ahead of the transfer station T2. The filter plugs which reach the conveyor 3 are inserted into the respective flutes in such a way that they are disposed in the gaps between the respective pairs of coaxial plain cigarettes which are delivered at the transfer station T2. Thus, each flute of the assembly conveyor 3 which advances beyond the transfer station T2 contains a group of three coaxial rod-shaped articles including a centrally located filter plug of double unit length and two plain cigarettes of unit length. Such groups are caused to advance between one or two condensing cams, springs or wheels *3a* which move one or both plain cigarettes of successive groups toward the respective filter plugs so that the inner end faces of the plain cigarettes contact the respective end faces of the associated filter plugs.

The condensed groups are transferred into successive flutes of a rotary drum-shaped intermediate conveyor 12.

The upper left-hand portion of the frame F is provided with a spindle 14*a* for a roll 14 of a convoluted web 13 of wrapping material (e.g., cigarette paper or imitation cork) which can be converted into discrete uniting bands serving to connect filter plugs to the adjacent end portions of the respective plain cigarettes. The web 13 is drawn off the roll 14 by two advancing rolls 16 at least one of which is driven by the prime mover PM of the machine and the other of which is preferably biased toward the driven roll. Prior to reaching the nip of the advancing rolls 16, successive increments of the web 13 advance through a splicing station SP and thereupon around a so-called curling device 17 which increases the tendency of the web 13 to roll and equalizes internal stresses in the material of the web. Reference may be had to commonly owned U.S. Pat. No. 3,962,957 granted Jun. 15, 1976 to Alfred Hinzmann.

The station SP includes a semiautomatic or automatic splicing device which serves to connect the leader of a fresh web 113 to the web 13 when the supply of web 13 on the spindle 14*a* is about to expire. The roll 114 which contains the supply of web 113 is mounted on a spindle 114*a*. A splicing device which can be used in the filter cigarette making machine of the present invention is disclosed, for example, in commonly owned U.S. Pat. No. 3,730,811 granted May 1, 1973 to Gerd-Joachim Wendt.

Successive increments of the running web 13 which advance beyond the curling device 17 are coated with adhesive by a paster 18 including a tank 18*a* for a supply of liquid adhesive, a withdrawing roll 18*b* which dips into the supply of adhesive in the tank 18*a*, and a roller-shaped applicator 18*c* whose peripheral surface receives a film of adhesive from the periphery of the roll 18*b* and transfers the adhesive to the underside of the running web 13.

The leader of the web 13 adheres to the peripheral surface of a rotary suction drum 19 which cooperates with the blades of a rotary knife 21 to subdivide the leader of the web into discrete uniting bands each of which has an adhesive-coated side. Such sides of successive uniting bands are caused to adhere to successive groups of rod-shaped articles on the intermediate conveyor 12. The application of uniting bands to successive groups is effected in such a way that each band adheres to the respective filter plug as well as to the inner end portions of the respective plain cigarettes of unit length.

Successive groups (each of which carries a uniting band) are thereupon transferred onto a rotary drum-shaped draping conveyor 22 which attracts the groups by suction and transports them past a normally stationary rolling device 23. The concave surface 39 of the rolling device 23 and the cylindrical peripheral surface 38 of the draping drum 22 define an arcuate gap G having a width which is slightly less than the diameter of a group whereby the groups which enter the gap G are caused to rotate about their respective axes and the uniting bands are converted into tubular envelopes which surround the respective filter plugs and the adjacent inner end portions of the corresponding plain cigarettes. Thus, each group which emerges from the gap G constitutes a filter cigarette of double unit length.

The rolling device 23 is heated (e.g., by an electric resistance heater whose conductors are shown at 123) to promote the setting of adhesive and to thus insure that the tubular envelopes of successive filter cigarettes of double unit length are reliably bonded to the adjacent rod-shaped components.

Successive filter cigarettes of double unit length are thereupon transferred into the peripheral flutes of a rotary drum-shaped drying conveyor 24 which is also heated to promote the setting of adhesive on the converted uniting bands. The conveyor 24 delivers successive filter cigarettes of double unit length to a rotary drum-shaped severing conveyor 26 which cooperates with a rotary disk-shaped knife 25 to subdivide each filter cigarette of double unit length into two coaxial filter cigarettes of unit length (hereinafter called filter cigarettes for short).

The severing conveyor 26 delivers successive pairs of coaxial filter cigarettes (each such cigarette includes a plain cigarette of unit length, one-half of a filter plug of double unit length and one-half of a tubular envelope) into successive flutes of a drum-shaped conveyor 27 forming part of a turn-around device 29, preferably of the type disclosed in commonly owned U.S. Pat.No. 3,583,546 granted June 8, 1971 to Gerhard Koop. One filter cigarette of each pair on the conveyor 27 is delivered to a second conveyor 27*a* of the turn-around device 29, and the other cigarette of each pair is transferred into alternate flutes of a third conveyor 28. The device 29 further comprises a set of orbiting inverting arms 29*a* which remove successive filter cigarettes from the conveyor 27*a*, turn the removed cigarettes end-for-end, and insert the inverted cigarettes into successive flutes of a fourth conveyor 28*a* which delivers the inverted cigarettes into the unoccupied flutes of the conveyor 28. Thus, the conveyor 28 accumulates a single row of parallel filter cigarettes wherein the filter mouthpieces of all filter cigarettes face in the same direction.

The severing conveyor 26 may constitute a component of a first testing unit which monitors the condition of wrappers of successive filter cigarettes of double unit length prior to severing and expels defective filter cigarettes of double unit length from their flutes, preferably in a direction at right angles to the plane of the drawing. A second testing device includes a rotary drum-shaped conveyor 31 which receives successive (alternating inverted and non-inverted) filter cigarettes from the conveyor 28 of the turn-around device 29 and transports such articles past a station where the exposed tobacco-containing ends of the filter cigarettes are examined for density of their fillers. Defective filter cigarettes (whose fillers are too dense or contain less than a minimum acceptable quantity of tobacco particles) are segregated from satisfactory filter cigarettes, either on the conveyor 31 or on a further conveyor 32 which deposits satisfactory filter cigarettes onto the upper reach of a take-off conveyor 36. The right-hand pulley 34 of the conveyor 36 cooperates with a braking wheel 33. The conveyor 36 can deliver filter cigarettes to storage, into so-called chargers or trays, or directly into the magazine of a packing machine, not shown.

In the event of a malfunction, the unit 37 which includes the conveyors 6, 8, 9 and 11 is deactivated, i.e., it ceases to deliver filter plugs to the flutes of the assembly conveyor 3, and the torque transmitting connection between the prime mover PM and the advancing roll or rolls 16 is interrupted shortly thereafter, i.e., the intermediate conveyor 12 ceases to receive discrete adhesive-coated uniting bands as soon as the last group of rod-shaped articles has advanced beyond the transfer station between the conveyor 12 and the suction drum 19. Furthermore, the guide roller 20 lifts the web 13 off the applicator 18c of the paster 18. A suitable detector (not shown) monitors the path for filter rod sections and filter plugs between the magazine 5 and the assembly conveyor 3. In the absence of filter rod sections or filter plugs, the detector transmits a signal which arrests the prime mover PM, i.e., the entire filter cigarette making machine comes to a standstill.

The peripheral surface 38 of the draping conveyor 22 is preferably formed with elongated ridges or webs which are parallel with the axis of the conveyor 22 and flank convex facets along which the groups roll during travel through the gap G. The ridges are shown, for example, in the commonly owned U.S. Pat. No. 3,001,528 granted Sept. 26, 1961 to Bernhard Schubert. The disclosure of this patent is incorporated herein by reference.

The rolling device 23 is stationary when the filter cigarette making machine is in use. When the machine is arrested, the rolling device 23 is retracted from the peripheral surface 38 of the draping conveyor 22 by displacing means including a parallel motion mechanism 40 which comprises two levers 43, 44 pivotable on shafts 41, 42 mounted in the frame F. The upper end portions of the levers 43, 44 are articulately connected to a link 46 which constitutes a carrier for the rolling device 23. The lever 43 is a bell crank lever and its lower arm is coupled to the piston rod 47 of a double-acting cylinder 48. The latter contains a reciprocable piston 47a which is connected to the inner end portion of the piston rod 47. The chambers 48a, 48b of the cylinder 48 can receive pressurized fluid via conduits 50a, 50b, depending on the position of the valving element of a two-position four-way valve 49. The solenoid 49a of the valve 49 can be energized by an amplifier 53 which is connected to a tachometer generator 52 serving as a means for monitoring the speed of the draping conveyor 22. When the conduit 50a is connected with a source 51 of pressurized fluid, the conduit 50b is connected with a tank 54, or vice versa. The source 51 may constitute an air compressor or an accumulator containing a supply of compressed gaseous fluid. In normal operation, the tachometer generator 52 causes the amplifier 53 to energize the solenoid 49a whereby the pneumatic motor including the cylinder 48 maintains the bell crank lever 43 in the illustrated (first) position, i.e., the width of the gap G is slightly less than the diameter of a group. The valving element of the valve 49 stresses the spring 49b. A stop 55 arrests the rolling element 23 in the first position.

When the speed of the draping conveyor 22 is reduced (e.g., to zero speed), the tachometer generator 52 ceases to transmit a signal to the amplifier 53 and the solenoid 49a is deenergized. The spring 49b of the valve 49 expands and causes the valving element to connect the conduit 50a with the tank 54 while simultaneously connecting the conduit 50b with the source 51. The piston rod 47 is retracted and the lever 43 moves the rolling device 23 to a second position at a greater distance from the draping conveyor 23.

The groups which happen to be located in the gap G when the rolling device 23 is retracted to second position are free to descend by gravity so that they cannot be overheated and do not adhere to or contaminate the concave surface 39 of the rolling device and/or the surface 38 of the draping conveyor 22. This is especially important when the filter plugs of groups in the gap G constitute or include "NWA-filters", i.e., filters which do not have discrete paper wrappers and whose material is likely to adhere to and contaminate the heated surface or surfaces of the draping apparatus.

An important advantage of the improved machine is that it can satisfactorily process NWA-filters and other rod-shaped articles which are sensitive to heat. Moreover, the machine is not likely to require cleaning as a result of contamination of the device 22 and/or 23 by the constituents of filter plugs, even after prolonged stoppage or slowdown. As a rule, the second or retracted position of the rolling device 23 will be selected in such a way that the rod-shaped articles which are located in the gap G immediately after stoppage or pronounced slowdown of the draping conveyor 22 are free to descend by gravity. It is clear, however, that the machine can include suitable means (e.g., a nozzle which can discharge one or more jets of compressed air against the surface 39) for promoting separation of groups of articles from the rolling device 23 as soon as the latter leaves the first or operative position which is shown in the drawing. This further reduces the likelihood of adherence of rod-shaped articles and/or uniting bands to the surface 39 when the prime mover PM is idle or is driven at such (low) speed at which the interval of contact between an NWA-filter and the surface 39 during travel of the respective group through the gap G would be sufficiently long to cause partial disintegration of the filter and contamination of the surface 38 and/or 39.

It is further within the purview of the invention to actuate the valve 49 so as to move the rolling device 23 away from the conveyor 22 in automatic response to stoppage of the prime mover PM, i.e., in response to opening of a switch or relay in the circuit of the prime mover if the latter constitutes an electric motor, or in response to closing of a valve or the like if the prime mover constitutes a fluid-operated motor.

As mentioned above, the motor including the cylinder 48 can be actuated to retract the rolling device 23 from the conveyor 22 in response to such deceleration of the prime mover PM that the interval of dwell of a group in the gap G is too long, i.e., that the filter plugs of groups in the gap G would be likely to undergo partial or complete disintegration and to adhere to the surface 38 and/or 39. The tachometer generator 52 can be readily designed in such a way that it causes the amplifier 53 to deenergize the solenoid 49a when the speed of the conveyor 22 is not zero but is below a predetermined minimum acceptable speed.

Commonly owned German Pat. No. 1,161,197 discloses a filter cigarette making machine wherein the rolling device is movable by hand. The purpose of such mounting of the rolling device is to allow for periodic removal of adhesive which accumulates on the surface of the rolling device. The latter is not heated, and its position does not change automatically in response to stoppage or pronounced slowdown of the machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a machine for convoluting adhesive-coated uniting bands around groups of coaxial rod-shaped articles having a predetermined diameter, the combination of a rotary draping device; a rolling device; means for heating at least one of said devices; displacing means actuatable to move one of said devices between a first position in which said one device is nearer to the other of said devices and said devices define a gap having a width slightly less than said predetermined diameter, and a second position in which said one device is more distant from said other device; means for delivering groups of articles and non-convoluted uniting bands to said draping device in parallelism with the axis of said draping device and ahead of said gap, as considered in the direction of rotation of said draping device, in said first position of said one device whereby the groups of articles are caused to rotate about their axes and the uniting bands are convoluted therearound during travel through said gap; and means for actuating said displacing means so as to move said one device to said second position in response to a reduction of operating speed of the machine to a predetermined minimum speed.

2. The combination of claim 1, wherein said one device is said rolling device.

3. The combination of claim 1, wherein said draping device comprises a drum having a peripheral rolling surface provided with equidistant webs extending in parallelism with the axis of said drum.

4. The combination of claim 1, wherein said heating means is arranged to heat said rolling device and said rolling device constitutes said one device, said displacing means including means for moving said rolling device substantially radially of said draping device.

5. The combination of claim 4, wherein said moving means includes a parallel motion and said actuating means comprises a fluid-operated motor.

6. The combination of claim 5, wherein said motor includes a pneumatic cylinder and piston unit.

7. The combination of claim 6, wherein said unit includes a double-acting cylinder and further comprising a source of pressurized fluid and a multi-position valve interposed between said cylinder and said source.

8. The combination of claim 1, wherein said actuating means includes means for monitoring the speed of said draping device and motor means operative to move said one device to said second position by way of said displacing means when the speed of said draping device reaches a predetermined minimum value.

9. The combination of claim 1, wherein said machine is a filter cigarette making machine and each group of rod-shaped articles includes two spaced-apart tobacco rods and a filter plug between such rods.

10. The combination of claim 1, wherein said machine further includes a prime mover and said actuating means includes means for causing said displacing means to move said one device to said second position in response to stoppage of said prime mover.

* * * * *